US007430996B2

(12) United States Patent
Sugie et al.

(10) Patent No.: US 7,430,996 B2
(45) Date of Patent: Oct. 7, 2008

(54) ELECTROMAGNETICALLY DRIVEN VALVE

(75) Inventors: Yutaka Sugie, Aichi-ken (JP); Masahiko Asano, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/492,828

(22) Filed: Jul. 26, 2006

(65) Prior Publication Data

US 2007/0022985 A1 Feb. 1, 2007

(30) Foreign Application Priority Data

Jul. 27, 2005 (JP) ..... 2005-217441

(51) Int. Cl.
*F01L 9/04* (2006.01)

(52) U.S. Cl. ..... 123/90.11; 251/129.01; 251/129.16

(58) Field of Classification Search ..... 123/90.11; 251/129.01, 129.15, 129.16
See application file for complete search history.

(56) References Cited

U.S. PATENT DOCUMENTS

| | | | | |
|---|---|---|---|---|
| 5,772,179 | A | 6/1998 | Morinigo et al. | |
| 6,467,441 | B2 | 10/2002 | Cristiani et al. | |
| 6,516,758 | B1 * | 2/2003 | Leiber | 123/90.11 |
| 6,546,904 | B2 * | 4/2003 | Marchioni et al. | 123/90.11 |
| 6,718,918 | B2 | 4/2004 | Meintschel et al. | |
| 2001/0054401 | A1 | 12/2001 | Cristiani et al. | |
| 2002/0020372 | A1 | 2/2002 | Stolk et al. | |
| 2002/0057154 | A1 | 5/2002 | Keck | |
| 2002/0069842 | A1 | 6/2002 | Curtis et al. | |

FOREIGN PATENT DOCUMENTS

| | | | |
|---|---|---|---|
| DE | 195 18 056 | A1 | 11/1996 |
| DE | 196 08 061 | A1 | 9/1997 |
| DE | 199 55 079 | A1 | 5/2000 |
| DE | 100 20 896 | A1 | 10/2001 |
| DE | 100 25 491 | A1 | 12/2001 |
| DE | 101 26 025 | A1 | 1/2002 |
| DE | 100 53 596 | A1 | 5/2002 |
| DE | 101 20 396 | A1 | 10/2002 |
| DE | 102 20 788 | A1 | 11/2003 |
| DE | 102 21 015 | A1 | 11/2003 |
| DE | 102 23 673 | A1 | 12/2003 |
| DE | 102 26 010 | A1 | 12/2003 |
| EP | 1 087 110 | A1 | 3/2001 |
| EP | 1 098 072 | A1 | 5/2001 |
| EP | 1 136 660 | A1 | 9/2001 |
| EP | 1 152 129 | A1 | 11/2001 |
| FR | 2 812 026 | A1 | 1/2002 |
| WO | WO 2006/018931 | A1 | 2/2006 |

* cited by examiner

*Primary Examiner*—Ching Chang
(74) *Attorney, Agent, or Firm*—Sughrue Mion, PLLC

(57) ABSTRACT

An electromagnetically driven valve includes a valve element, a main body, a disc, and a lower electromagnetic. The valve element includes a valve stem, and is reciprocated in the direction in which the valve stem extends. The main body is provided at a position distant from the valve element. The disc includes a driving end that is moved in conjunction with the valve stem, and a pivoting end that is supported by the main body such that the pivoting end can be oscillated. The disc is oscillated around a central axis that extends at the pivoting end. The lower electromagnet is disposed so as to face the disc. The lower electromagnetic includes a core made of magnetic material, and a coil wound in the core. The coil is offset to a driving end side with respect to a central of the core.

20 Claims, 11 Drawing Sheets

ELECTROMAGNETICALLY DRIVEN VALVE

INCORPORATION BY REFERENCE

The disclosure of Japanese Patent Application No. 2005-217441 filed on Jul. 27, 2005 including the specification, drawings and abstract is incorporated herein by reference in its entirety.

BACKGROUND OF THE INVENTION

1. Field of the Invention

The invention generally relates to an electromagnetically driven valve. More specifically, one embodiment relates to a pivot-type electromagnetically driven valve for an internal combustion engine, which is driven by an elastic force and an electromagnetic force. The invention may be used, for example, in the field of electromagnetically driven valves for an internal combustion engine that is provided for a vehicle.

2. Description of the Related Art

U.S. Pat. No. 6,467,441 describes a pivot-type electromagnetically driven valve that includes two coils. In the electromagnetically driven valve, a supporting point is provided in a disc (armature). In conventional electromagnetically driven valves, a large gap exists between a disc and an electromagnet and a small electromagnetic force is provided at an end portion. As a result of this arrangement, it is difficult to obtain a large initial driving force. Further, it is necessary to increase the amount of electric current to obtain the large initial driving force. But increasing the amount of electric current necessarily increases the amount of consumed electric power.

SUMMARY OF THE INVENTION

In view of the above shortcoming attendant with the conventional electromagnetically driven valve, it is an object of the invention to provide an electromagnetically driven valve that can increase the initial driving force.

An electromagnetically driven valve according to an embodiment of the invention is operated by electromagnetic force. The electromagnetically driven valve includes a valve element, an oscillating member, a support member, and an electromagnet. The valve element includes a valve shaft, and is reciprocated in the direction the valve shaft extends. The oscillating member extends from a driving end that is moved in conjunction with the valve element, to a pivoting end. The oscillating member is oscillated around a central axis that extends at the pivoting end. The support member supports the pivoting end of the oscillating member. The electromagnet is provided so as to face the oscillating member. The electromagnet includes a core made of magnetic material, and a coil wound in the core. The coil is offset to a driving end side with respect to a center of the core.

In the electromagnetically driven valve having the aforementioned configuration, the coil is offset to the driving end side with respect to the center of the core. Therefore, the width of the flux path is large on the pivoting end side, that is, on the central-axis side. Because the distance between the electromagnet and the oscillating member is short on the pivoting end side, a large electromagnetic force can be obtained when operation of the electromagnetically driven valve is started.

A protrusion which is made of magnetic material, and which extends toward the oscillating member, may be provided in the core at a portion on the driving end side. In this case, a gap between the core and the oscillating member can be reduced by the protrusion. Therefore, the density of magnetic flux can be increased, and the electromagnetic force can be increased.

A convex portion may be provided in the core at a weld portion on the driving end side. In this case, iron loss due to welding can be prevented, and the amount of consumed electric power can be reduced.

According to one exemplary embodiment of the invention, it is possible to provide an electromagnetically driven valve that can increase the initial driving force.

BRIEF DESCRIPTION OF THE DRAWINGS

The foregoing and further objects, features and advantages of the invention will become apparent from the following description of example embodiments with reference to the accompanying drawings, wherein the same or corresponding portion are denoted by the same reference numerals and wherein.

DETAILED DESCRIPTION OF THE PREFERRED EMBODIMENTS

Figure 1:
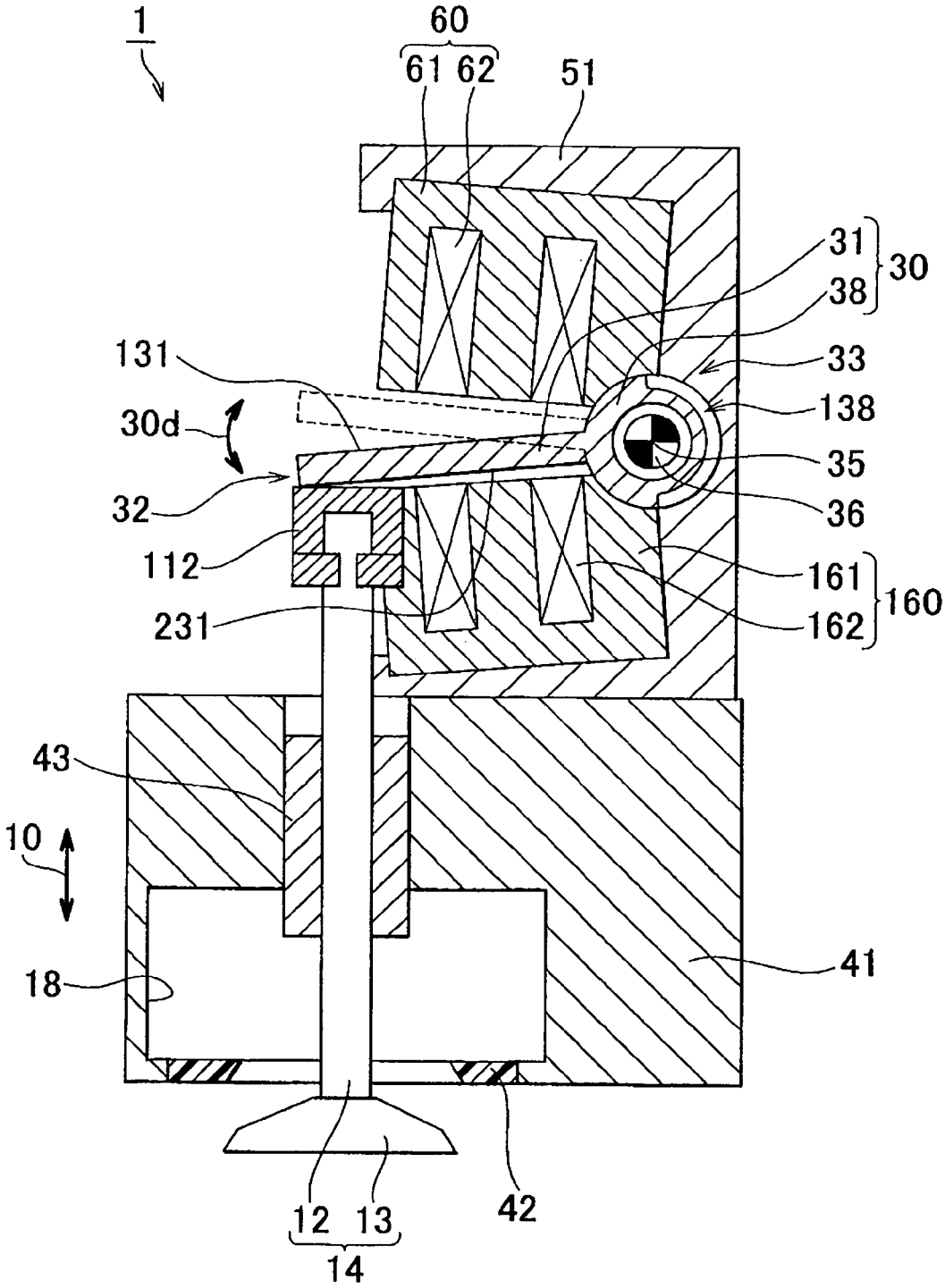
FIG. 1 is a cross-sectional view of an electromagnetically driven valve according to a first embodiment of the invention.

Hereinafter, exemplary embodiments of the invention will be described with reference to the drawings. In the following embodiments, the same and corresponding portions are denoted by the same reference numerals, and the description thereof will not be repeated.

FIG. 1 is a cross-sectional view of an electromagnetically driven valve according to a first exemplary embodiment of the invention. As shown in FIG. 1, an electromagnetically driven valve 1 includes a main body 51, an upper electromagnet 60, a lower electromagnet 160, a disc 30, and a valve stem 12. The upper electromagnet 60 and the lower electromagnet 160 are fitted to the main body 51. The disc 30 is provided between the upper electromagnet 60 and the lower electromagnet 160. The valve stem 12 is driven by the disc 30.

The main body 51 has a U-shape cross section, and serves as a base member. Various elements are fitted to the main body 51. The upper electromagnet 60 includes a core 61 made of magnetic material, and a coil 62 wound in the core 61. The lower electromagnet 160 includes a core 161 made of magnetic material, and a coil 162 wound in the core 161. When each of the coils 62 and 162 is energized, a magnetic field is generated. The disc 30 is driven by the magnetic field.

The disc 30 is provided between the upper electromagnet 60 and the lower electromagnet 160, and is attracted to the upper electromagnet 60 or the lower electromagnet 160 by the attraction force (electromagnetic force) thereof. As a result, the disc 30 is reciprocated between the upper electromagnet 60 and the lower electromagnet 160. The reciprocating motion of the disc 30 is transmitted to the valve stem 12.

The electromagnetically driven valve 1 is operated by electric power. The electromagnetically driven valve 1 includes a valve element 14, the main body 51, the disc 30, and the upper and lower electromagnets 60 and 160. The valve element 14 includes the valve stem 12 that serves as the valve shaft, and is reciprocated in a direction in which the valve stem 12 extends (i.e., the direction indicated by an arrow 10). The main body 51, which serves as the support member, is provided at a position distant from the valve element 14. The disc 30 includes a driving end 32 that is moved in conjunction with the valve stem 12, and a pivoting end 33 that is supported by the main body 51 such that the pivoting end 33 can be oscillated. The disc 30 is oscillated around a rotational axis 35 that extends at the pivoting end 33. The disc 30 serves as the oscillating member. The rotational axis 35 serves as the central axis. The upper electromagnet 60 and the lower electromagnet 160 are disposed so as to face the disc 30. The upper electromagnet 60 includes the core 61 made of magnetic material, and the coil 62 wound in the core 61. The lower electromagnet 160 includes the core 161 made of magnetic material, and the coil 162 wound in the core 161. The coil 62 is offset to a driving end 32 side (i.e., the side closer to the driving end 32 than to the pivoting end 33) with respect to a central axis 261 of the core 61. The coil 162 is also offset to the driving end 32 side with respect to the central axis 261 of the core 161.

The electromagnetically driven valve 1 in this embodiment constitutes an intake valve or an exhaust valve of an internal combustion engine, such as a gasoline engine or a diesel engine. In this embodiment, the valve element 14 is used as an intake valve provided in an intake port 18. However, the valve 1 may be applied to the case where the valve element 14 is used as an exhaust valve.

The electromagnetically driven valve 1 shown in FIG. 1 is a pivot-type electromagnetically driven valve. The disc 30 is used as a motion mechanism. The main body 51 is provided on a cylinder head 41. The lower electromagnet 160 is provided in a lower area of the main body 51. The upper electromagnet 60 is provided in an upper area of the main body 51. The lower electromagnet 160 includes the core 161 made of iron, and the coil 162 wound in the core 161. By supplying electric current to the coil 162, the magnetic field is generated around the coil 162. The disc 30 is attracted to the lower electromagnet 160 by this magnetic field.

The upper electromagnet 60 includes the core 61 made of iron, and the coil 62 wound in the core 61. By supplying electric current to the coil 62, the magnetic field is generated around the coil 62. The disc 30 is attracted to the upper electromagnet 60 by this magnetic field.

The coil 62 of the upper electromagnet 60 may be connected to the coil 162 of the lower electromagnet 160. In this case, the coils 62 and 162 form a single coil. Alternatively, the coil 62 may be separated from the coil 162. The number of turns of the coil 62 wound in the core 61 is not limited to a specific number. Also, the number of turns of the coil 162 wound in the core 161 is not limited to a specific number.

The disc 30 includes an arm portion 31 and a bearing portion 38. The arm portion 31 extends from the driving end 32 to the pivoting end 33. The arm portion 31 is attracted by the upper electromagnet 60 or the lower electromagnet 160. As a result, the arm portion 31 is pivoted (oscillated) in a direction shown by an arrow 30*d*. The bearing portion 38 is fitted to an end portion of the arm portion 31. The arm portion 31 is pivoted around the bearing portion 38. The arm portion 31 can pivot such that an upper surface 131 of the arm portion 31 contacts the upper electromagnet 60, and such that a lower surface 231 of the arm portion 31 contacts the lower electromagnet 160, and a cap 112.

The bearing portion 38 has a cylindrical shape. A torsion bar 36 is provided inside the bearing portion 38. One end portion of the torsion bar 36 is spline fitting to the main body 51. The other end portion of the torsion bar 36 is fitted to the bearing portion 38. Thus, when the bearing portion 38 is about to pivot, a force resisting the movement is applied to the bearing portion 38 from the torsion bar 36. Thus, the bearing portion 38 is always urged toward a neutral position. The driving end 32 of the disc 30 presses the valve stem 12 via the cap 112. The valve stem 12 is guided by a stem guide 43.

Intake ports 18 are provided in a lower area of the cylinder head 41. Intake air is introduced to a combustion chamber through each intake port 18. That is, an air-fuel mixture or air passes through each intake port 18. A valve seat 42 is provided between the intake port 18 and the combustion chamber. The valve seat 42 serves to increase the sealability of the valve element 14.

The valve element 14 that is used as an intake valve is fitted to the cylinder head 41. The valve element 14 includes the valve stem 12 and a bell portion 13. The valve stem 12 extends in the longitudinal direction. The bell portion 13 is provided at the end of the valve stem 12. The valve stem 12 is fitted to the cap 112 which has a gate shape.

Figure 2:
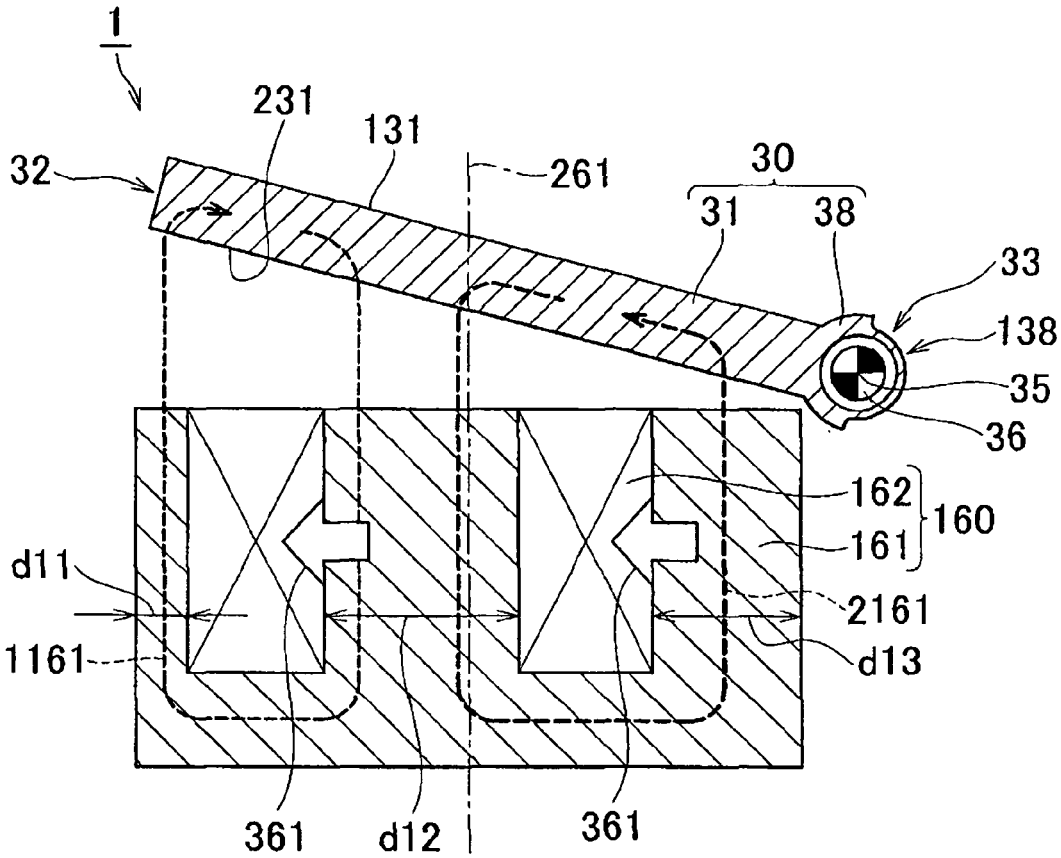
FIG. 2 is an enlarged cross-sectional view of a lower electromagnet.

FIG. 2 is an enlarged cross-sectional view of the lower electromagnet. As shown in FIG. 2, the coil 162 is offset to the driving end 32 side in a direction shown by an arrow 361 with respect to the central axis 261 of the core 161. The width of a flux path on the driving end 32 side is denoted by d11. The width of the flux path on a pivoting end 33 side (i.e., the side closer to the pivoting end 33 (rotational-axis 35) than to the driving end 32) is denoted by d13. The width d13 is larger than the width d11. The width of the flux path at the center portion of the core 161 is denoted by d12. The center of the width d12 is positioned on the left side of the central axis 261. The distance or gap between the disc 30 and the lower electromagnet 160 decreases toward the pivoting end 33 from the driving end 32. That is, the gap is large on the driving end 32 side, and the gap is small on the pivoting end 33 side. In the lower electromagnet 160, a magnetic circuit 1161 and a magnetic circuit 2161 are generated. Each of the two magnetic circuits 1161 and 2161 generates the electromagnetic force, which attracts the disc 30 closer to the lower electromagnet 160. The force of each magnetic circuit that attracts the disc 30 closer to the lower electromagnet 160 depends on the magnetic flux density in the magnetic circuit and the distance or gap between the lower electromagnet 160 and the disc 30. In this embodiment, because the coil 162 is offset to the driving end 32 side, the width d13 on the pivoting end 33 side is large in the core 161. Therefore, a large amount of magnetic flux passes through this large-width portion. Also, the distance between the large-width portion and the disc 30 is short. Accordingly, a large force can be obtained even in the initial stage due to the effect of the magnetic circuit 2161. That is, in the flap type electromagnetically driven valve 1, the gap (distance between the lower electromagnet 160 and the disc 30) at the position distant from the rotational axis 35 is different from the gap at the position close to the rotational axis 35, and the magnetic flux density in these two gaps is uneven. To solve this problem, the widths of the flux path are set such that saturation of the magnetic flux density can be prevented on the pivoting end 33 side, by shifting the coil 162 to the driving end 32 side. This increases the electromagnetic force, and reduces the amount of electric current that is used, thereby reducing the amount of consumed electric power.

Figure 3:
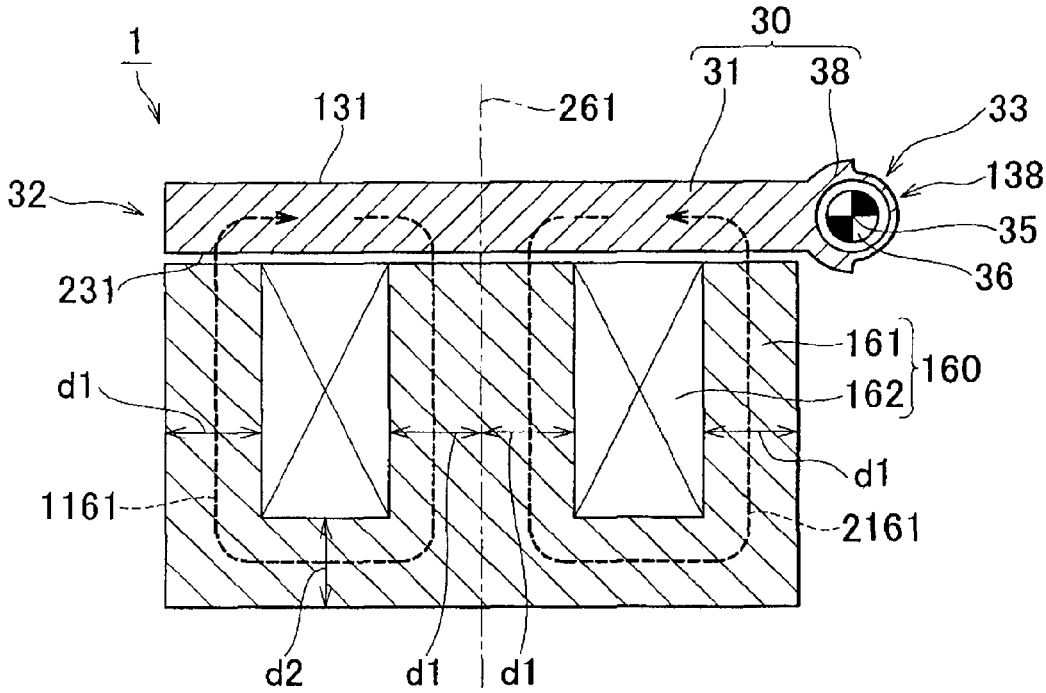
FIG. 3 RELATED ART
FIG. 3 is a cross-sectional view of a conventional lower electromagnet.

FIG. 3 is a cross-sectional view of a lower electromagnet in a conventional valve. As shown in FIG. 3, the lower electromagnet 160 includes the core 161 and the coil 162. The coil 162 is wound in the core 161. However, the conventional lower electromagnet is different from the lower electromagnet 160 shown in FIG. 2 in that the width of the flux path on the right side is the same as that on the left side. As shown in FIG. 3, the width of the flux path on the right side of the central axis 261 is the same as that on the left side of the central axis 261 in the core 161. That is, the lower electromagnet 160 in FIG. 3 has a symmetric shape. The width of the flux path on each of the right and left sides is denoted by "d1". The width of the flux path at the lower portion of the core 161 is denoted by "d2". The disc 30 with driving end 32 and pivoting end 33 is placed above the lower electromagnet 160.

Figure 4:
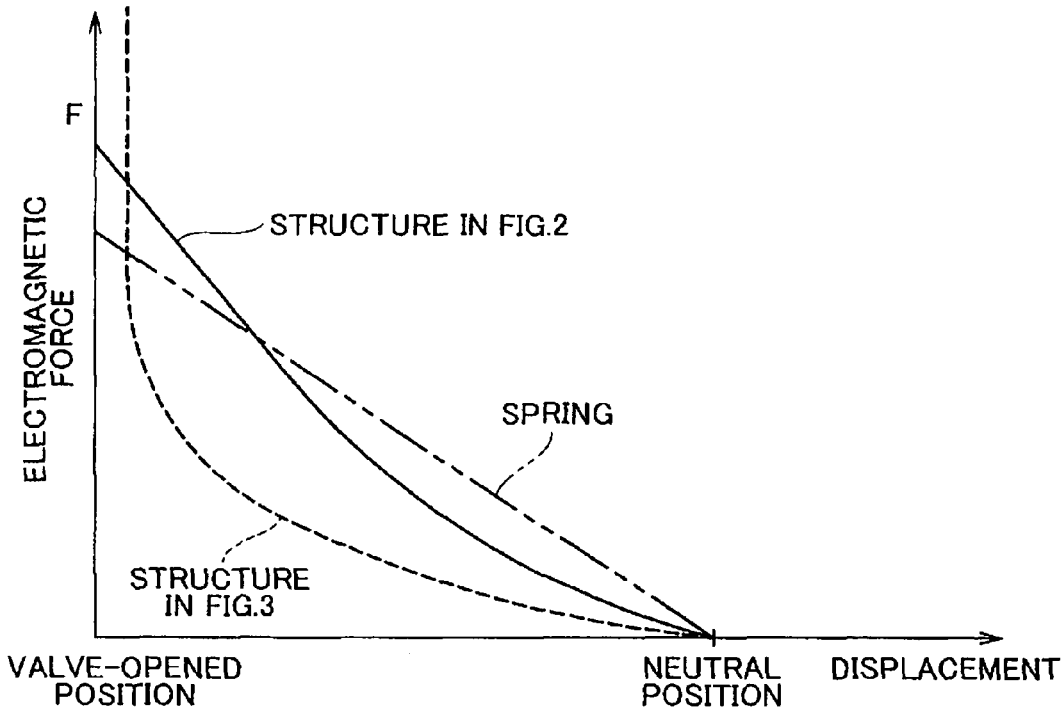
FIG. 4 is a graph showing the relation between the displacement of a disc and an electromagnetic force in structures shown in FIG. 2 and FIG. 3.

FIG. 4 is a graph showing the relation between the displacement of the disc and the electromagnetic force in the structure shown in FIG. 2 and in the structure shown in FIG. 3. When the electromagnetic force is not applied between the upper electromagnet 60 and the lower electromagnet 160, the disc 30 is placed in the "neutral position" in FIG. 4. When the disc 30 contacts the lower electromagnet 160, the disc 30 is placed in the "valve-opened position" in FIG. 4. The spring force of the torsion bar 36 is proportional to the displacement of the torsion bar 36. That is, as the torsion bar 36 is displaced from the neutral position, the spring force of the torsion bar 36 increases.

In the conventional structure shown in FIG. 3, when the amount of electric current supplied to the coil 162 is constant, the force applied between the disc 30 and the lower electromagnet 160 is related to the distance between the disc 30 and the lower electromagnet 160. When the distance is long, the force is small. Conversely, when the distance is short, the force is large. When the disc 30 is placed in the neutral position, the distance between the disc 30 and the lower electromagnet 160 is long, and therefore the electromagnetic force is small, particularly on the driving end 32 side. However, as the distance between the disc 30 and the lower electromagnet 160 becomes shorter, the electromagnetic force becomes larger. Because the driving end 32 is distant from the rotational axis 35, the electromagnetic force at the driving end 32 has a great effect on the attraction. Accordingly, the electromagnetic force sharply increases near the "valve-opened position" in FIG. 4.

In the structure shown in FIG. 2, because the coil 162 is offset to the driving end 32 side, the width d13 of the flux path on the pivoting end 33 side is large, unlike the structure shown in FIG. 3. As a result, a large electromagnetic force is generated when the disc 30 is placed at the neutral position. In the structure shown in FIG. 2, a large electromagnetic force is generated when the disc 30 is placed in a region near the neutral position, as compared to the structure shown in FIG. 3. The widths of the flux path are set such that saturation of the magnetic flux is prevented, by offsetting the coil 162 to the driving end 32 side. This increases the electromagnetic force, and reduces the amount of used electric current and the amount of consumed electric power.

Next, the operation of the electromagnetically driven valve according to the first embodiment will be described. When the electromagnetically driven valve 1 is operated, electric current is supplied to the coil 62 that constitutes the upper electromagnet 60 or the coil 162 that constitutes the lower electromagnet 160. In the first embodiment of FIG. 1, for example, electric current is supplied to the coil 62. As a result, the magnetic field is generated around the coil 62, and the arm portion 31 of the disc 30, which is made of magnetic material, is attracted to the upper electromagnet 60. As a result, the arm portion 31 is pivoted upward, the torsion bar 36 is twisted, and the torsion bar 36 is about to move the arm portion 31 in the opposite direction. However, because the attraction force of the upper electromagnet 60 is strong, the arm portion 31 is further pivoted upward, and finally, the upper surface 131 contacts the upper electromagnet 60. As the arm portion 31 is moved upward, the cap 112 connected to the arm portion 31 and the valve element 14 are moved upward, and finally the bell portion 13 contacts the valve seat 42. Thus, the valve element 14 is placed in a closed position.

When the valve element 14 is placed in an opened position, the arm portion 31 needs to be moved downward. In this case, supply of electric current to the coil 62 is stopped, or the amount of electric current supplied to the coil 62 is decreased. As a result, the electromagnetic force that acts between the electromagnet 60 and the arm portion 31 is decreased. Because the torsion force is applied to the arm portion 31 by the torsion bar 36, the torsion force (elastic force) overcomes the electromagnetic force, and the arm portion 31 is moved to the vicinity of the neutral position in FIG. 1. Then, electric current is supplied to the coil 162 that constitutes the lower electromagnet 160. As a result, the magnetic field is generated around the coil 162, and the arm portion 31 made of magnetic material is attracted to the lower electromagnet 160. At this time, the arm portion 31 moves the cap 112 and the valve element 14 downward. The attraction force of the coil 162 overcomes the torsion force of the torsion bar 36. Finally, the lower surface 231 contacts the lower electromagnet 160. At this time, the valve element 14 is moved downward, and the valve element 14 is placed in the opened position. By moving the arm portion 31 upward and downward repeatedly in this manner, the arm portion 31 pivots in the direction shown by the arrow 30*d*. When the arm portion 31 pivots, the bearing portion 38 connected to the arm portion 31 also pivots.

Thus, according to this embodiment, the electromagnetic force can be increased, and the amount of used electric current and the amount of consumed electric power can be reduced.

Figure 5:
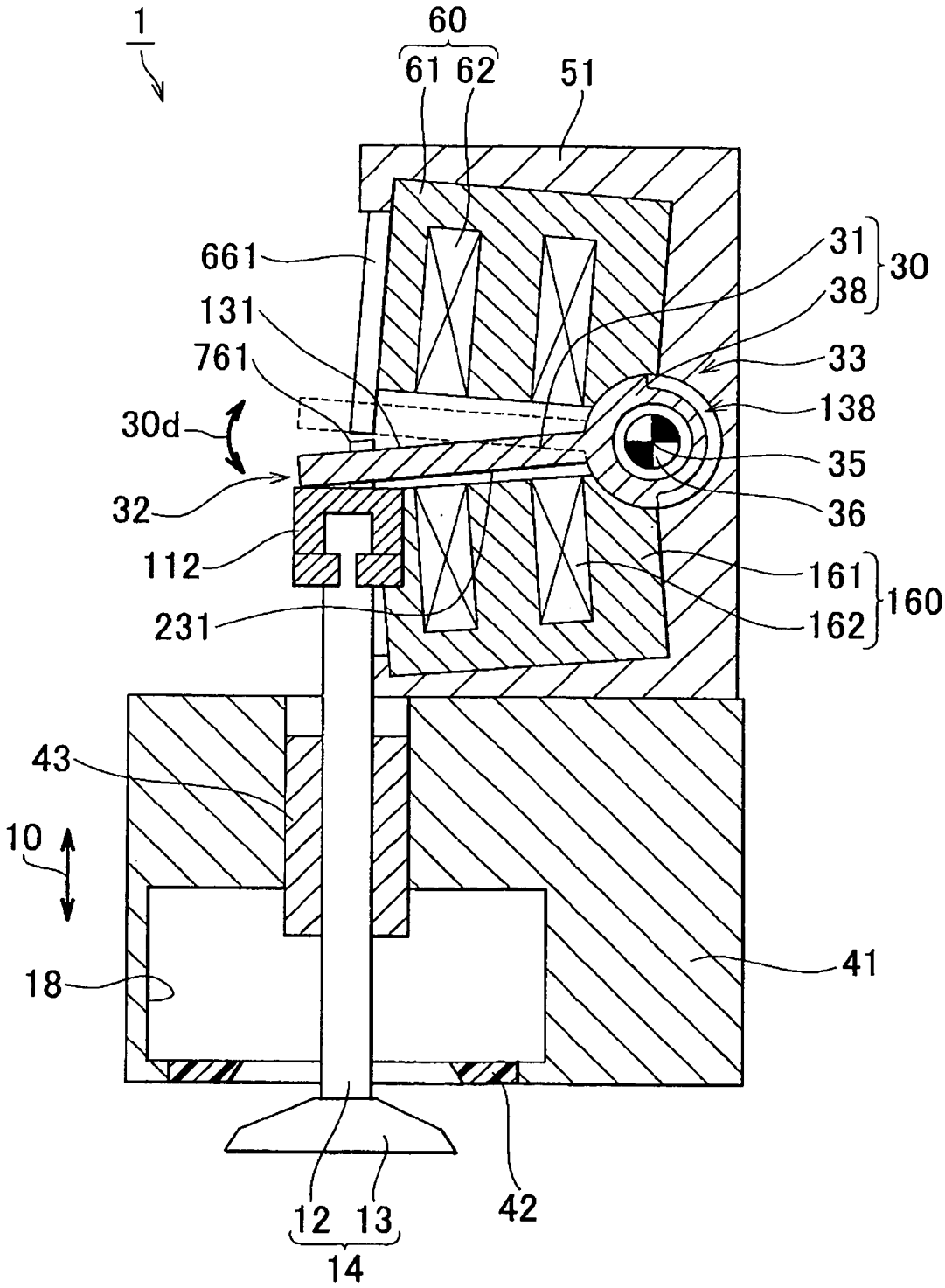
FIG. 5 is a cross-sectional view of an electromagnetically driven valve according to a second embodiment of the invention.

FIG. 5 is a cross-sectional view of an electromagnetically driven valve according to a second embodiment. As shown in FIG. 5, the electromagnetically driven valve 1 according to the second embodiment is different from the electromagnetically driven valve according to the first embodiment in that a protrusion 661 is provided in the upper electromagnet 60 at a portion on the driving end 32 side, and a protrusion 761 is provided in the lower electromagnet 160 at a portion on the driving end 32 side.

In the first embodiment, the coil 62 of the upper electromagnet 60 and the coil 162 of the lower electromagnet 160 are both offset to the driving end 32 side. However, the coil 62 of the upper electromagnet 60 and/or the coil 162 of the lower electromagnet 160 may be offset to the driving end 32 side.

In the second embodiment, the protrusions 661 and 761 are made of magnetic material. Each of the protrusions 661 and 761 forms a magnetic circuit. The protrusions 661 and 761 are provided such that the protrusions 661 and 761 do not interfere with the disc 30 that is reciprocated.

Figure 6:
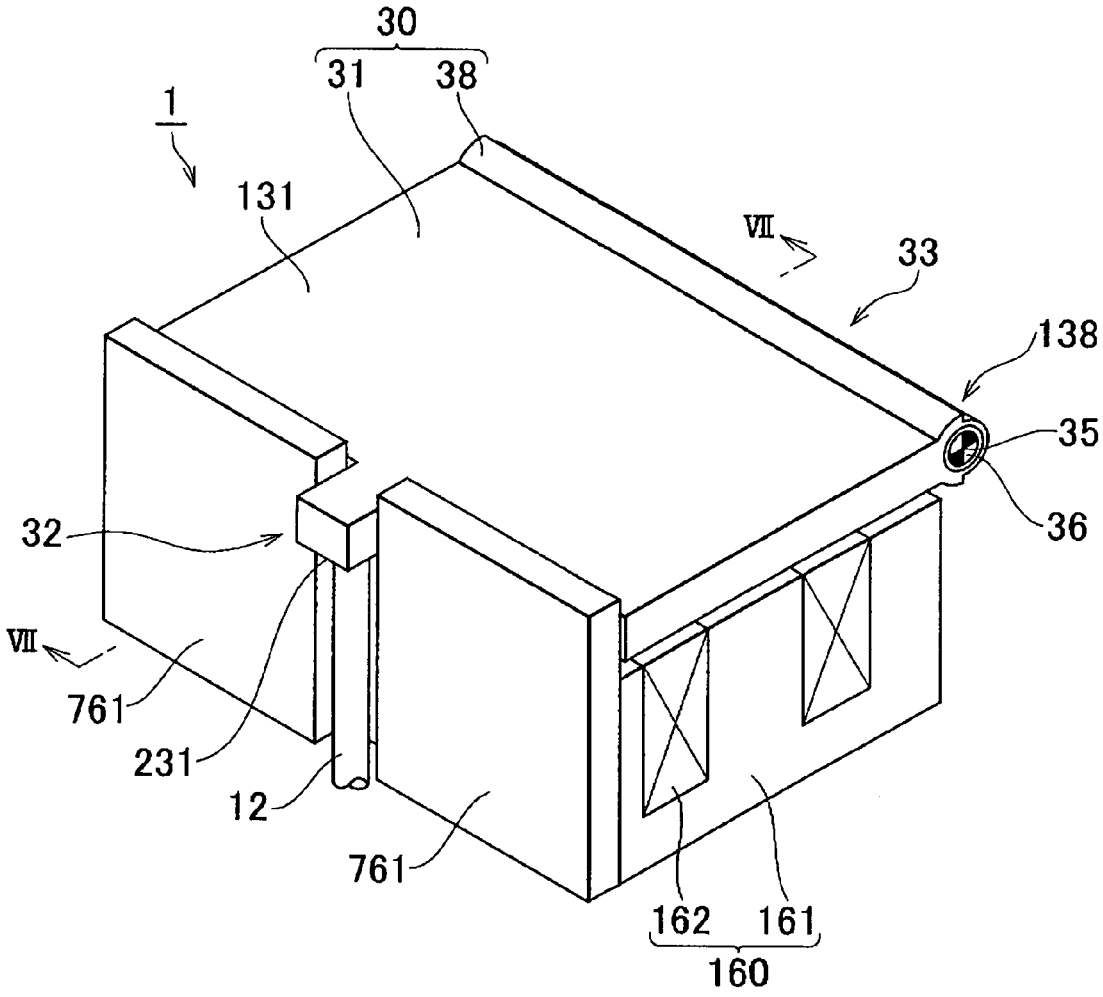
FIG. 6 is a perspective view of a portion of a lower electromagnet provided with a protrusion.

FIG. 6 is a perspective view of a portion of the lower electromagnet provided with the protrusion 761. As shown in FIG. 6, the protrusion 761 is provided so as to contact the core 161. The protrusion 761 extends in the depth direction, and has a shape that does not directly interfere with the valve stem 12 and the arm portion 31. The protrusion 761 has a thin-plate shape. For example, the protrusion 761 is made of magnetic material such as iron.

Figure 7:
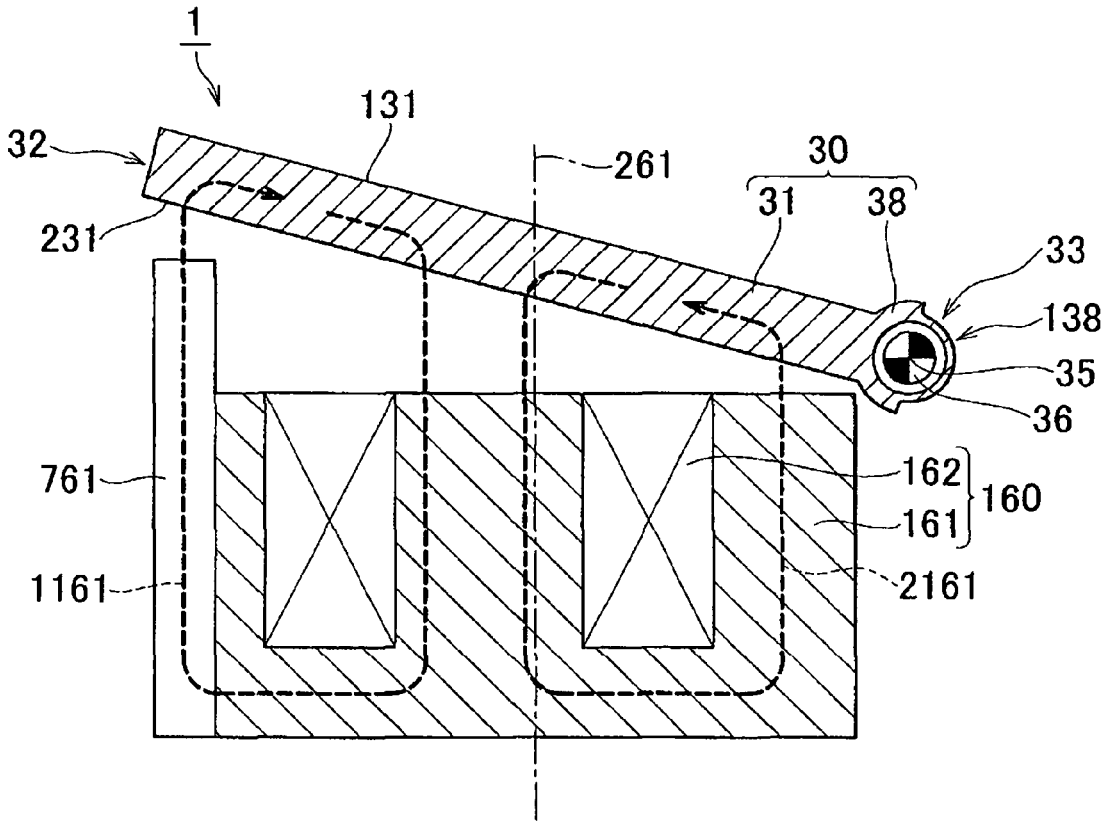
FIG. 7 is a cross-sectional view taken along line VII-VII in FIG. 6.

FIG. 7 is a cross-sectional view taken along line VII-VII in FIG. 6. As shown in FIG. 7, the protrusion 76 extends toward the arm portion 31. The protrusion 761 forms the magnetic circuit 1161. In the magnetic circuit 1161, because the distance between the protrusion 761 and the arm portion 31 is short, the electromagnetic force is large. Further, by providing the protrusion 761, the area of the flux path on the driving end 32 side is increased. As a result, the amount of magnetic flux can be increased, and a strong force can be generated on the driving end 32 side. Because the driving end 32 is distant from the rotational axis 35, rotational torque is increased by increasing the electromagnetic force at the driving end 32. The torque is obtained as the product of the electromagnetic force and the length of the arm. Therefore, by increasing the electromagnetic force at the area distant from the rotational axis 35, the amount of used electric current and the amount of consumed electric power can be reduced.

Figure 8:
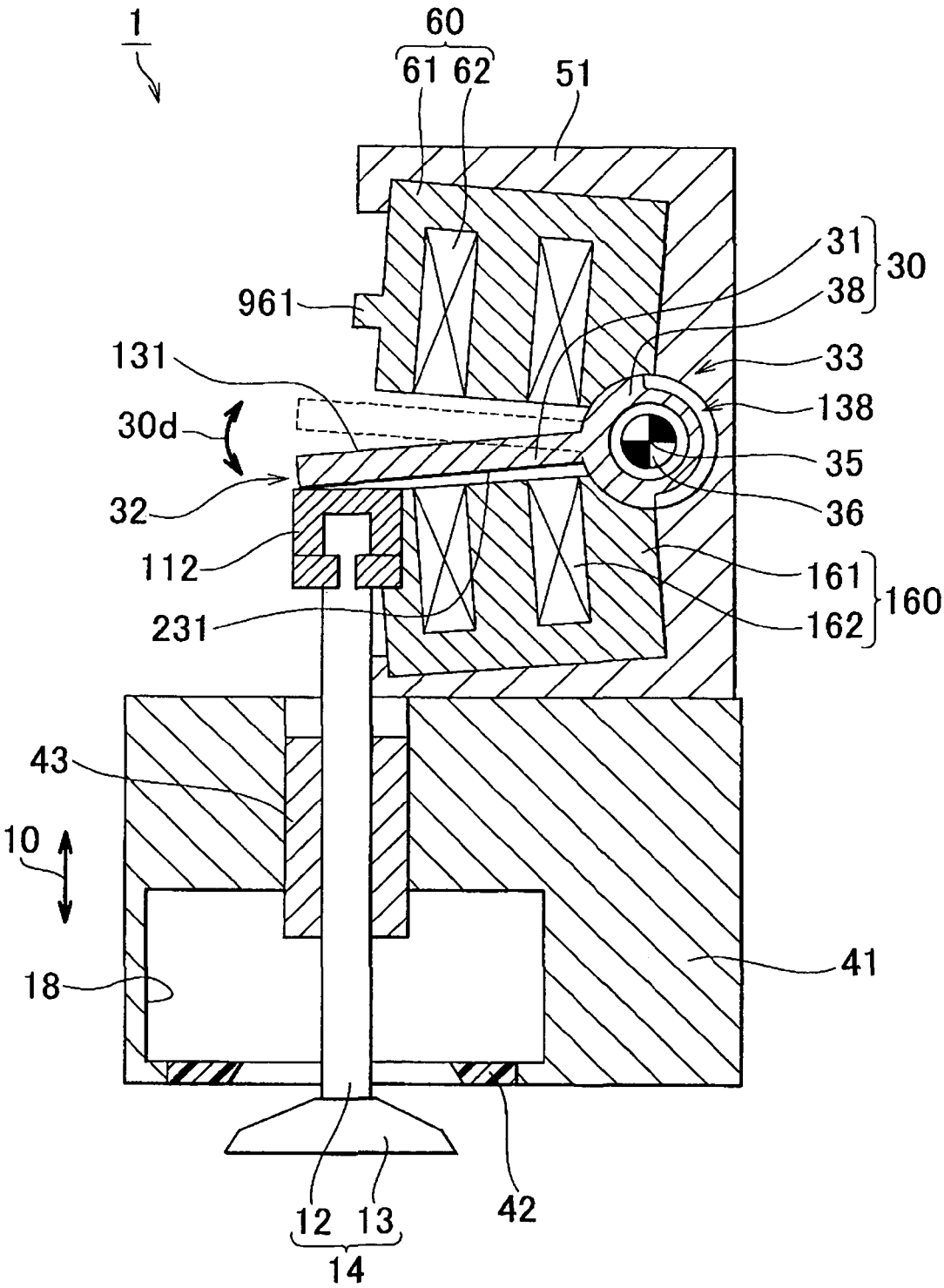
FIG. 8 is a cross-sectional view of an electromagnetically driven valve according to a third embodiment of the invention.

FIG. 8 is a cross-sectional view of an electromagnetically driven valve according to a third embodiment of the invention. The electromagnetically driven valve 1 according to the third embodiment is different from the electromagnetically driven valve 1 according to the first embodiment in that protrusions 961 are provided in the upper electromagnet 60, and the protrusions 961 are welded to each other. Each protrusion 961 is made of magnetic steel plate that constitutes the core 61. Protrusions 861 (not shown in FIG. 8) are provided also in the lower electromagnet 160. The protrusions 861 are provided on the driving end 32 side.

Figure 9:
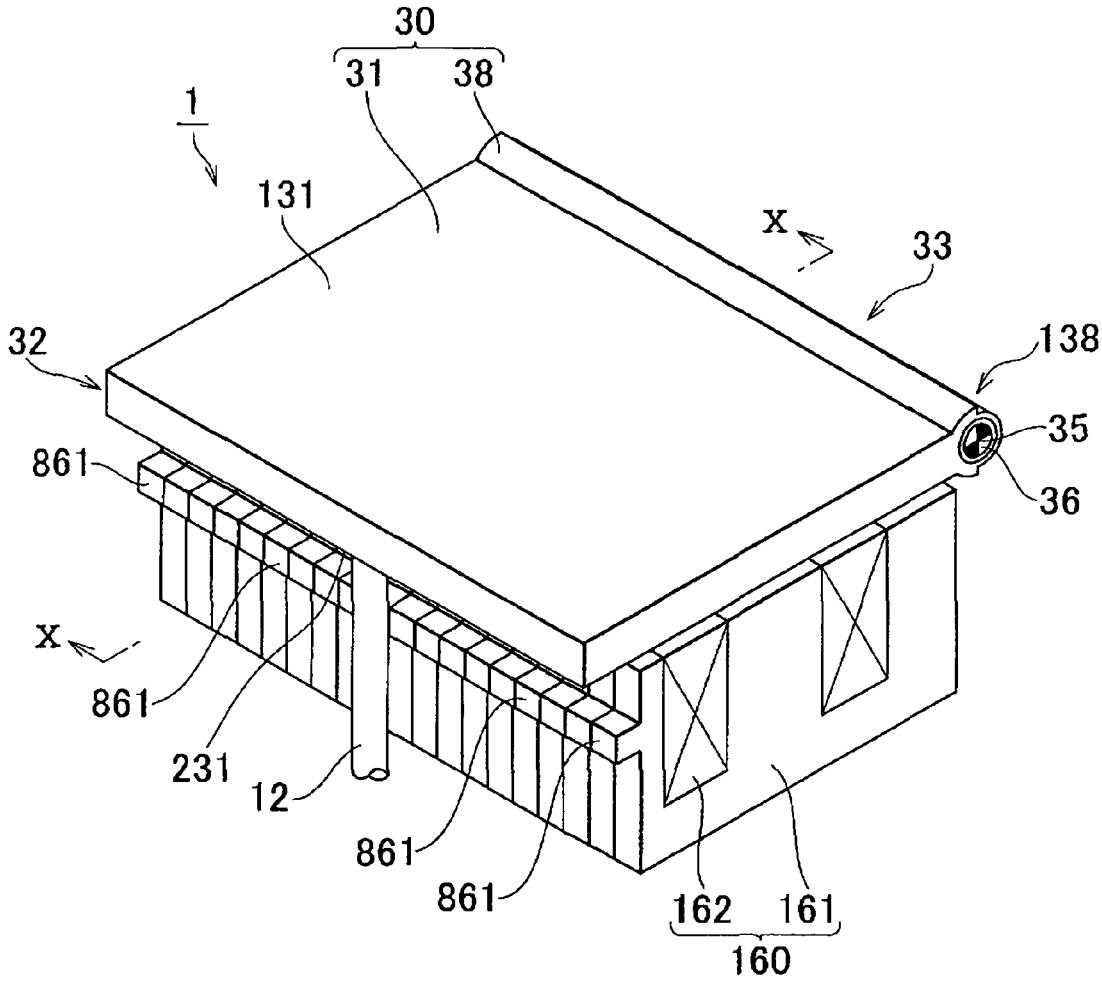
FIG. 9 is a perspective view of a portion of a lower electromagnet provided with protrusions.

FIG. 9 is a perspective view of a portion of the lower electromagnet provided with the protrusions 861. As shown in FIG. 9, the core 161 that constitutes the lower electromagnet 160 is formed by stacking a plurality of electromagnetic steel plates. The protrusion 861 is provided in each of the electromagnetic steel plates. The protrusions 861 in the plurality of electromagnetic steel plates are used to connect the plurality of electromagnetic steel plates. By welding the protrusions 861 to each other, the plurality of electromagnetic steel plates are joined to each other.

Figure 10:
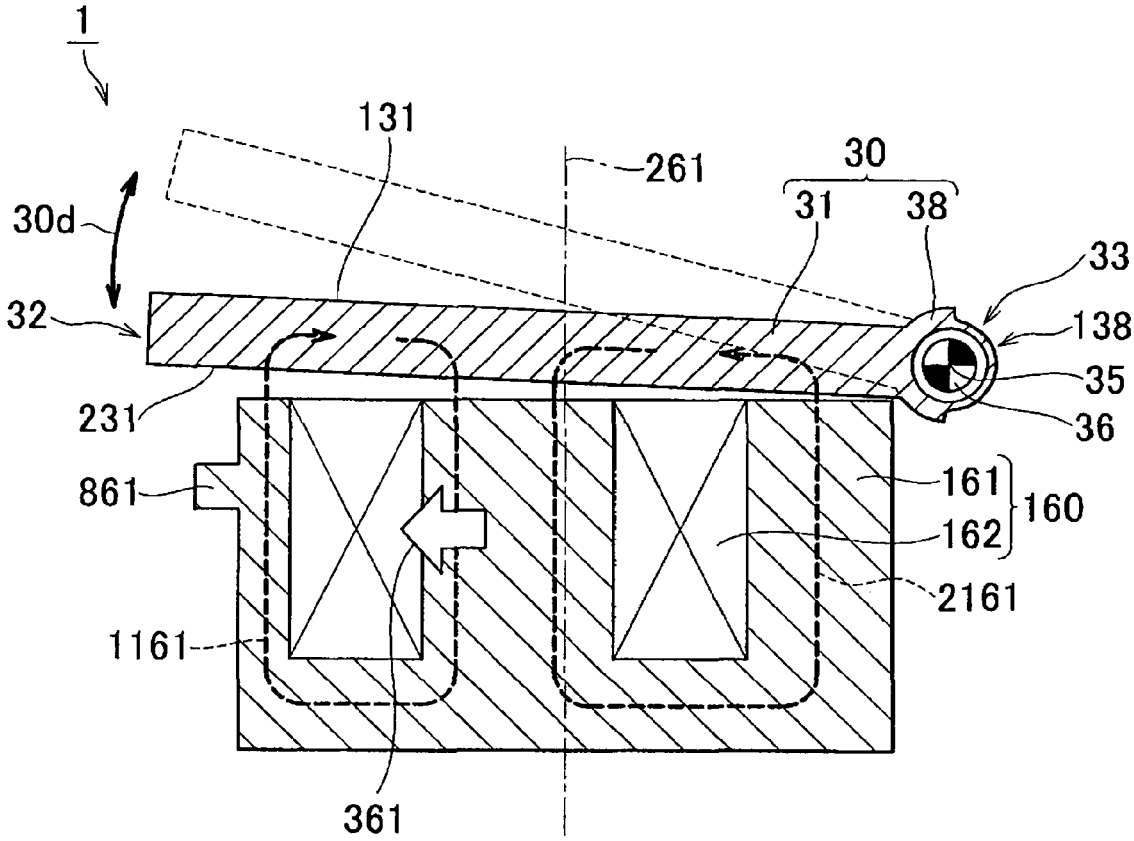
FIG. 10 is a cross-sectional view taken along line X-X in FIG. 9.

FIG. 10 is a cross-sectional view taken along line X-X in FIG. 9. When the coil 162 is offset to the driving end 32 side, the width of magnetic flux on the driving end 32 side is small in the core 161. Therefore, if the protrusions 861 are not provided and the electromagnetic plates of the core 161 are welded at a portion on the driving end 32 side, iron loss may be increased due to welding. Accordingly, in this embodiment, the protrusions 861 used for welding are provided. That is, the protrusions 861 are welded to each other. Therefore, even if iron loss is increased due to welding in the protrusions 861, the magnetic field is not greatly affected. As a result, responsiveness is improved, and the amount of consumed electric power can be reduced.

Figure 11:
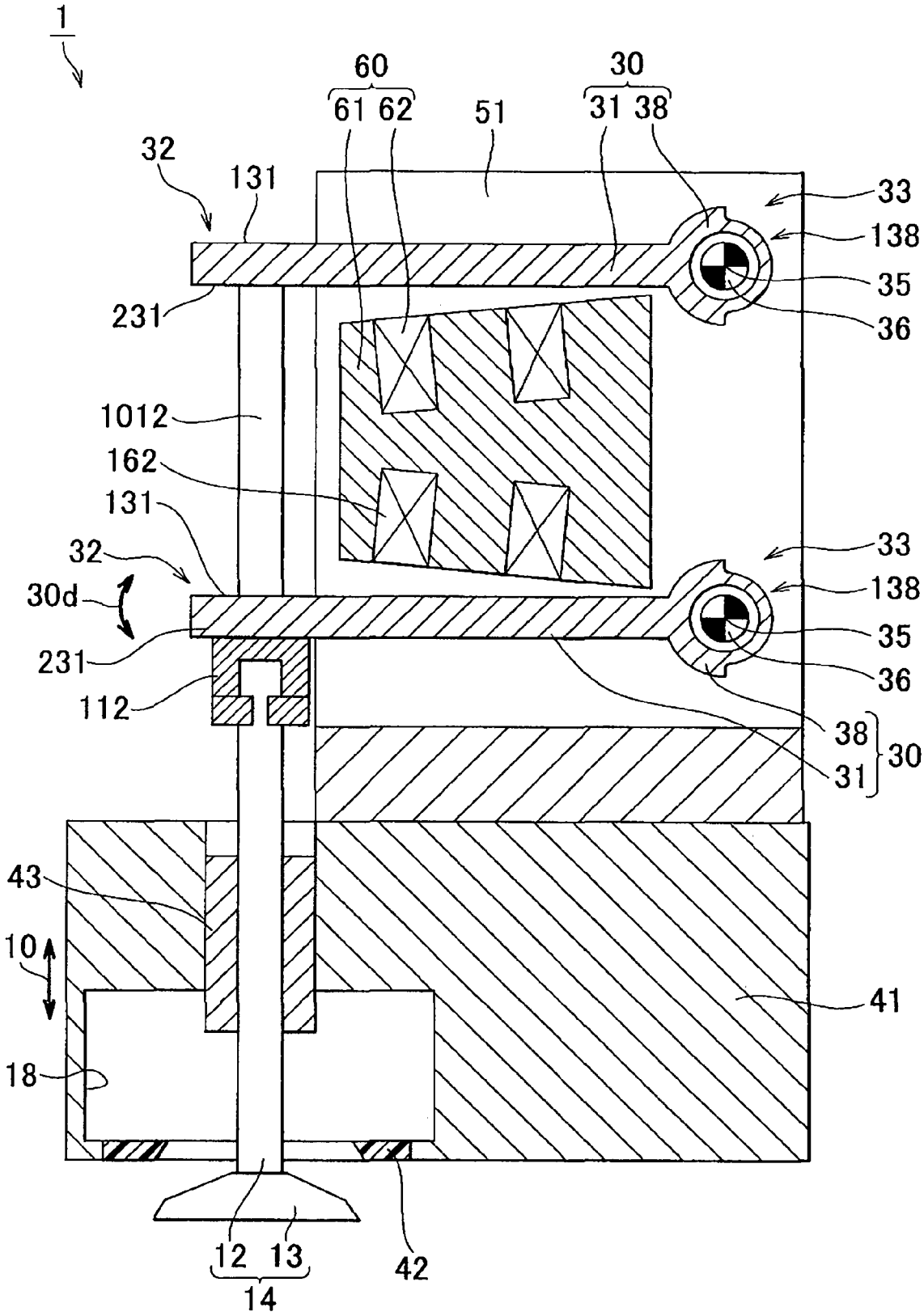
FIG. 11 is a cross-sectional view of an electromagnetically driven valve according to a fourth embodiment of the invention.

FIG. 11 is a cross-sectional view of an electromagnetically driven valve according to a fourth embodiment. As shown in FIG. 11, the electromagnetically driven valve 1 according to the fourth embodiment is different from the electromagnetically driven valve according to the first embodiment in that two discs 30, which are an upper disc and a lower disc, are provided. The discs 30 are connected to each other by a stem 1012. The coils 62 and 162 are offset to the driving end 32 side.

The electromagnetically driven valve 1 having the aforementioned configuration according to the fourth embodiment has the same effect as that of the electromagnetically driven valve according to the first embodiment.

Although the embodiments of the invention have been described, various modifications may be made to the embodiments. In each of the first to third embodiments, one disc 30 is used. However, in each of the first to third embodiments, two discs 30 may be used as in the fourth embodiment shown in FIG. 11.

Moreover, the coil 62 that constitutes the upper electromagnet 60 may be composed of one coil, or a plurality of coils. The coil 162 that constitutes the lower electromagnet 160 may also be composed of one coil, or a plurality of coils.

Thus, the embodiment of the invention that has been disclosed in the specification is to be considered in all respects as illustrative and not restrictive. The technical scope of the invention is defined by claims, and all changes which come within the meaning and range of equivalency of the claims are therefore intended to be embraced therein.

What is claimed is:

1. An electromagnetically driven valve that is operated by an electromagnetic force, comprising:

a valve element which includes a valve shaft, and which is reciprocated in a direction in which the valve shaft extends;

an oscillating member which extends from a driving end, that is moved in conjunction with the valve shaft, to a pivoting end, and which is oscillated around a central axis that extends at the pivoting end;

a support member that supports the pivoting end of the oscillating member; and an electromagnet that is disposed so as to face the oscillating member, wherein the electromagnet includes a core made of magnetic material and having a central axis, and a coil wound in the core, and wherein a width of a flux path of the core at a pivoting end side is larger than a width of a flux path of the core at a driving end side, and the coil is offset to a driving end side with respect to the center axis.

2. The electromagnetically driven valve according to claim 1, further comprising a protrusion made of magnetic material, said protrusion extending toward the oscillating member, and being provided in the core at a portion on the driving end side.

3. The electromagnetically driven valve according to claim 1, wherein a protrusion is provided in the core at a weld portion on the driving end side.

4. An electromagnetically driven valve that is operated by an electromagnetic force, comprising:

a valve element;

a support member;

an oscillating member, supported by said support member, and operable to move in conjunction with said valve element, wherein the oscillating member extends from a driving end, that is moved in conjunction with the valve element, to a pivoting end; and an electromagnet disposed so as to face the oscillating member, and including a core made of magnetic material, and a coil wound in the core, wherein a width of a flux path of the core at the pivoting end side is larger than a width of a flux path of the core at a driving end side, and said coil being offset to a driving end side with respect to a center of the core.

5. The electromagnetically driven valve according to claim 4, wherein said coil is offset from the center of the core towards a freed end of said oscillating member.

6. The electromagnetically driven valve according to claim 4, wherein said electromagnet includes an upper electromagnet and a lower electromagnet.

7. The electromagnetically driven valve according to claim 6, wherein said support member supports the upper and lower electromagnets.

8. The electromagnetically driven valve according to claim 7, wherein each of the upper and lower electromagnets includes a magnetic core and a coil wound in the core.

9. The electromagnetically driven valve according to claim 6, wherein said oscillating member is operable to oscillate between a position adjacent the upper electromagnet and a position adjacent the lower electromagnet.

10. The electromagnetically driven valve according to claim 9, wherein said oscillating member comprises a disc disposed between the upper and lower electromagnets.

11. The electromagnetically driven valve according to claim 10, wherein said disc includes an arm portion and a bearing portion.

12. The electromagnetically driven valve according to claim 10, wherein said disc is operable to be oscillated to a position that seats the valve element.

13. The electromagnetically driven valve according to claim 12, wherein each of the upper and lower electromagnets includes a protrusion located at a driving end of said disc and made of magnetic material.

14. The electromagnetically driven valve according to claim 13, wherein each of the protrusions forms at least a part of a magnetic circuit.

15. The electromagnetically driven valve according to claim 13, wherein each of the protrusions has a thin-plate shape.

16. The electromagnetically driven valve according to claim 12, wherein the core of the lower electromagnet comprises a plurality of electromagnetic plates, wherein each plate includes a protrusion, and wherein the protrusions are welded together.

17. An electromagnetically driven valve that is operated by an electromagnetic force, comprising:

a valve element;

a support member;

an oscillating member supported by said support member and comprising upper and lower discs connected to each other, wherein the oscillating member extends from a driving end, that is moved in conjunction with the valve element, to a pivoting end; and an electromagnet disposed between said discs, and including a core made of magnetic material, and at least one coil wound in the core, wherein a width of a flux path of the core at a pivoting end side is larger than a width of a flux path of the core at a driving end side, and said coil being offset to a driving end side with respect to a center of the core.

18. The electromagnetically driven valve according to claim 17, wherein said at least one coil is offset with respect to a center of the core towards a free end of said oscillating member.

19. The electromagnetically driven valve according to claim 18, wherein each of the upper and lower discs includes an arm portion and a bearing portion, and wherein the oscillating member oscillates to a position that seats the valve element.

20. The electromagnetically driven valve according to claim 19, wherein the valve element includes a shaft and a bell portion provided at the end of the shaft, and wherein the oscillating member oscillates to a position that seats the bell portion of the valve element.

* * * * *